US012102216B2

(12) United States Patent
Wolters

(10) Patent No.: US 12,102,216 B2
(45) Date of Patent: Oct. 1, 2024

(54) CARGO CARRYING STRAP SYSTEM

(71) Applicant: Mark Theodore Wolters, Sherwood Park (CA)

(72) Inventor: Mark Theodore Wolters, Sherwood Park (CA)

( * ) Notice: Subject to any disclaimer, the term of this patent is extended or adjusted under 35 U.S.C. 154(b) by 0 days.

(21) Appl. No.: 17/467,199

(22) Filed: Sep. 4, 2021

(65) Prior Publication Data

US 2022/0071375 A1 Mar. 10, 2022

Related U.S. Application Data

(60) Provisional application No. 63/075,698, filed on Sep. 8, 2020.

(51) Int. Cl.
*A45F 3/14* (2006.01)
*A45F 5/10* (2006.01)

(52) U.S. Cl.
CPC ..... *A45F 3/14* (2013.01); *A45F 5/10* (2013.01); *A45F 2003/142* (2013.01); *A45F 2005/1013* (2013.01)

(58) Field of Classification Search
CPC ..... A45F 3/14; A45F 5/10; A45F 2003/142; A45F 2005/1013
USPC ..... 224/250
See application file for complete search history.

(56) References Cited

U.S. PATENT DOCUMENTS

| | | | | | |
|---|---|---|---|---|---|
| 164,994 | A * | 6/1875 | Harrell | A45F 5/10 | 294/157 |
| 495,151 | A * | 4/1893 | Desmarais | A45C 7/0031 | 190/27 |
| 799,793 | A | 9/1905 | Kinsella | | |
| 841,620 | A * | 1/1907 | Buchanan | A45C 13/20 | 190/27 |
| 1,082,017 | A | 12/1913 | Feinen | | |
| 1,187,496 | A * | 6/1916 | Bullock | A45F 5/10 | 294/170 |
| 1,847,501 | A * | 3/1932 | Stahler | A45F 5/10 | 294/157 |
| 2,978,154 | A * | 4/1961 | Kailey | A45F 5/10 | 294/157 |
| 3,172,586 | A * | 3/1965 | Lu | A45F 5/12 | 294/155 |
| 3,923,222 | A * | 12/1975 | Groves | B65D 33/06 | D3/315 |

(Continued)

FOREIGN PATENT DOCUMENTS

| | | |
|---|---|---|
| CA | 3017472 | 3/2019 |
| GB | 191105314 | 2/1912 |

OTHER PUBLICATIONS

Canadian Office Action corresponding to application No. 3,130,611 mailed Jan. 20, 2023.

(Continued)

*Primary Examiner* — Nathan J Newhouse
*Assistant Examiner* — Lester L Vanterpool

(57) ABSTRACT

A cargo carrying strap system is discussed, the strap system having a handle assembly and one or more vertical straps for wrapping around a vertical perimeter of a piece of cargo. The strap system can further include a perimeter strap for wrapping around an edge perimeter of the cargo and a horizontal strap for wrapping around a horizontal perimeter of the cargo.

20 Claims, 6 Drawing Sheets

(56) References Cited

U.S. PATENT DOCUMENTS 3,933,287 A * 1/1976 Foley ..... B65D 63/18 294/149
4,127,223 A * 11/1978 Uchin ..... A45F 5/00 224/257
4,483,380 A * 11/1984 Beran ..... A45C 3/00 206/523
4,559,906 A * 12/1985 Smith ..... A01K 29/00 119/728
4,656,566 A * 4/1987 Kelley ..... A47J 45/077 215/396
4,796,936 A * 1/1989 Sherin ..... A45F 5/10 294/151
4,804,218 A * 2/1989 Hilliard ..... B63C 11/22 294/157
4,867,359 A * 9/1989 Donovan ..... A63C 11/023 224/264
5,054,816 A * 10/1991 Rosengarten ..... B42D 9/004 206/472
5,148,956 A * 9/1992 Funk ..... A01K 1/0263 294/157
5,558,382 A * 9/1996 Wengler ..... A45F 5/10 294/157
6,193,293 B1 * 2/2001 Ybanez ..... B65G 7/12 294/157
6,953,214 B2 * 10/2005 Paz ..... A45F 3/14 294/157
7,093,324 B2 * 8/2006 Udy ..... A45F 3/14 16/444
D564,761 S * 3/2008 McGlenn ..... D3/327
7,976,088 B1 * 7/2011 Diciolla ..... A45C 13/42 294/157
8,123,236 B1 * 2/2012 Helenihi ..... B62B 5/0083 280/35
D689,284 S * 9/2013 Weitzel ..... D3/315
8,579,345 B2 * 11/2013 LeClaire ..... A45F 5/10 294/151
8,616,600 B2 * 12/2013 Owen ..... A63C 11/021 294/154
8,998,052 B1 * 4/2015 Mitchell ..... A45F 3/14 224/660
9,107,489 B1 * 8/2015 Wisniewski ..... A45F 5/10
D743,628 S * 11/2015 Millington ..... D29/101.1
D760,653 S * 7/2016 Lorino ..... D13/119
9,681,738 B1 * 6/2017 Herrera ..... A45C 13/30
10,039,368 B2 * 8/2018 Christman ..... A45F 3/14
10,464,727 B1 * 11/2019 Rerecich ..... B65D 63/10
11,134,770 B2 * 10/2021 Valentsov ..... A45F 5/10
11,147,361 B2 * 10/2021 Krivokapic ..... A45F 5/10
D948,871 S * 4/2022 Azpurua Baez ..... D3/327
2003/0222110 A1 * 12/2003 Chou ..... B65D 63/18 224/250
2006/0055192 A1 * 3/2006 Hirsch ..... A45F 3/04 294/157
2008/0042460 A1 * 2/2008 Fuchs ..... A45C 13/30 294/150
2009/0057358 A1 * 3/2009 Cheesman ..... A45C 13/30 224/250
2009/0200347 A1 * 8/2009 Edralin ..... A45F 5/00 224/191
2014/0239656 A1 * 8/2014 Hancey ..... A45F 5/10 294/170
2016/0100671 A1 * 4/2016 Zets ..... A45C 11/20 224/250
2017/0008661 A1 * 1/2017 Flatley ..... B65D 5/46008
2017/0027308 A1 * 2/2017 Christman ..... A45F 3/14
2017/0055688 A1 * 3/2017 Lewis ..... A45F 5/10
2018/0206621 A1 * 7/2018 Harness ..... A45F 3/15
2019/0092571 A1 * 3/2019 Rumboldt ..... B65G 7/12
2020/0297102 A1 * 9/2020 Valentsov ..... A45F 5/10

OTHER PUBLICATIONS

Canadian Office Action corresponding to application No. 3, 130,611 mailed Feb. 16, 2024.

* cited by examiner

CARGO CARRYING STRAP SYSTEM

CROSS-REFERENCE TO RELATED APPLICATIONS

This application claims priority of U.S. Provisional Patent Application Ser. No. 63/075,698 filed Sep. 8, 2020, which is incorporated by reference into this application in its entirety.

TECHNICAL FIELD

The present disclosure is related to the field of cargo carrying straps, in particular, cargo carrying strap systems that can be easily attached to, and detached from, cargo such as boxes, cases and the like.

BACKGROUND

Goods packaged in large or odd-shaped boxes can be awkward or difficult to lift and carry, especially if the boxes lack handholds or openings for grasping and carrying. For example, flat-screen televisions often are packed in cardboard boxes that are wide and tall but thin in depth and often require two persons to carry due to the awkwardness in carrying such a box. In other circumstances, storage cases or suitcases may have a handle but may be too narrow or difficult to grasp or may have had the handle broken off making lifting and carrying of such cases difficult or impossible.

It is, therefore, desirable to provide a cargo carrying strap system that can be easily attached to, and detached from, the boxes and cases described above to enable the lifting and carrying thereof.

SUMMARY

In some embodiments, a cargo carrying strap system can be provided, the strap system comprising a handle assembly and one or more vertical straps for wrapping around a vertical perimeter of a piece of cargo. In some embodiments, the strap system can further comprise a perimeter strap for wrapping around an edge perimeter of the cargo. In some embodiments, the strap system can further comprise a horizontal strap for wrapping around a horizontal perimeter of the cargo.

Broadly stated, in some embodiments, a strap system can be provide for lifting and carrying cargo, the system comprising: a handle assembly configured for placement on top of the cargo; and at least one vertical strap operatively coupled to the handle assembly, the at least one vertical strap configured for wrapping around the cargo in a vertical direction.

Broadly stated, in some embodiments, the at least one vertical strap can further comprise a first releasable strap connector.

Broadly stated, in some embodiments, the handle assembly can further comprise a handle operatively coupled to a handle base.

Broadly stated, in some embodiments, the handle and the at least one vertical strap can be coupled to the handle base with at least one fastener.

Broadly stated, in some embodiments, the at least one fastener can comprise one or more of threaded fasteners, rivets, grommets, threaded stitching and adhesive.

Broadly stated, in some embodiments, the strap system can further comprise a horizontal strap configured for wrapping around a horizontal perimeter of the cargo, the horizontal strap configured for releasably attaching to the at least one vertical strap.

Broadly stated, in some embodiments, the strap system can further comprise a connector strap disposed on the at least one vertical strap, the connector strap further comprising second releasable strap connectors configured for releasably attaching to the horizontal strap.

Broadly stated, in some embodiments, the system can further comprise a perimeter strap configured for wrapping around an edge perimeter of the cargo, the perimeter strap configured for releasably attaching to the handle assembly.

Broadly stated, in some embodiments, the strap system can further comprise third releasable strap connectors disposed on opposing ends of the handle assembly configured for releasably attaching to the perimeter strap.

DETAILED DESCRIPTION OF EMBODIMENTS

In this description, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment can also be included in other embodiments but is not necessarily included. Thus, the present technology can include a variety of combinations and/or integrations of the embodiments described herein.

Figure 1:
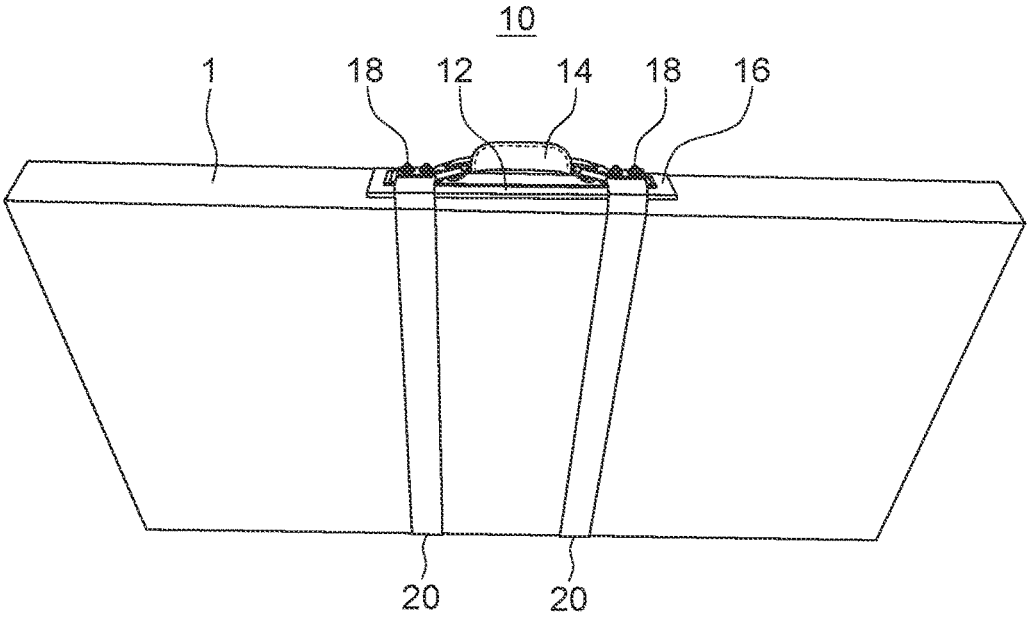
FIG. 1 is a side perspective view depicting a first embodiment of a cargo carrying strap system attached to a box.
Figure 2:
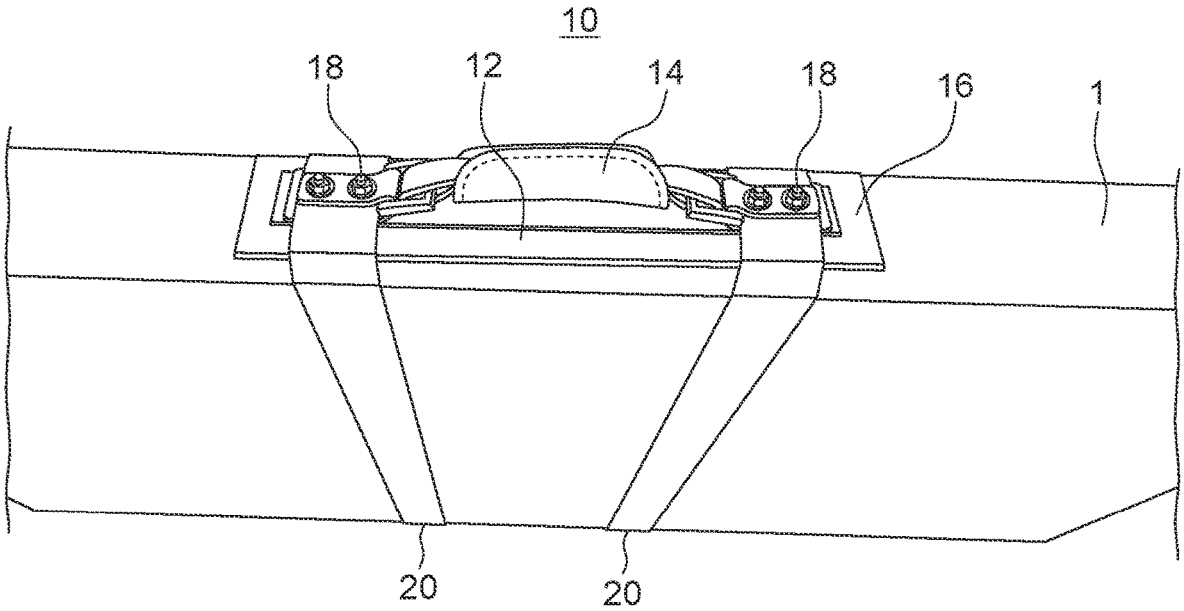
FIG. 2 is a close-up perspective view depicting the cargo carrying strap system of FIG. 1.
Figure 3:
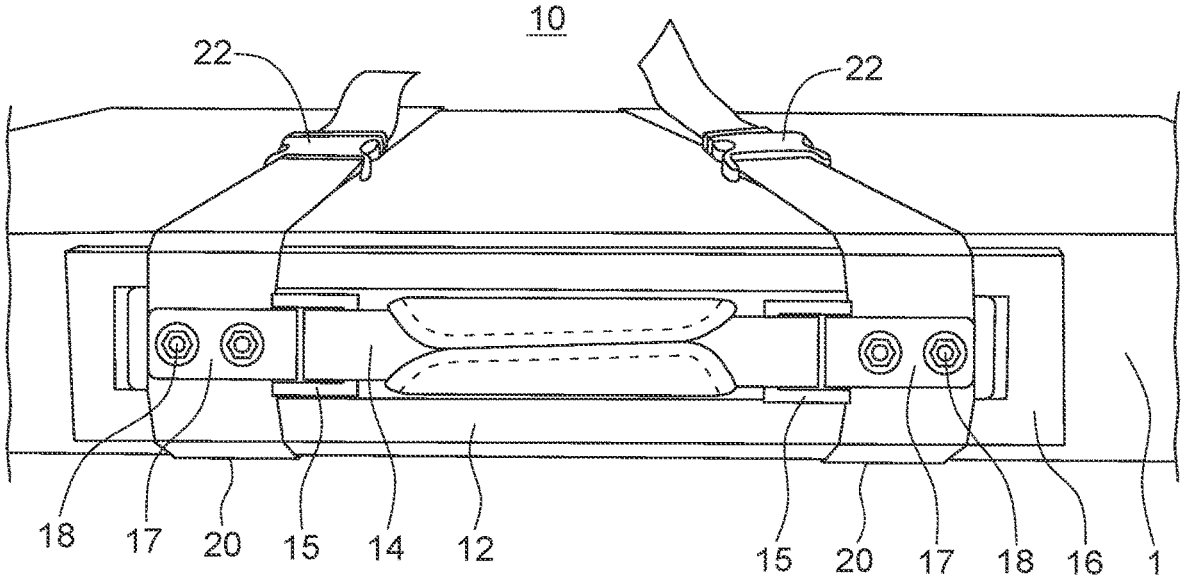
FIG. 3 is a top perspective view depicting the cargo carrying strap system of FIG. 1.

Referring to FIGS. 1 to 3, a first embodiment of cargo carrying strap system 10 is shown attached to box 1. In some embodiments, strap system 10 can comprise of handle assembly 12 fastened to one or more vertical straps 20 with fasteners 18, wherein straps 20 are disposed around a vertical perimeter of box 1. In some embodiments, strap assembly 12 can comprise of handle 14 operatively attached to handle base 16. In some embodiments, handle base 16 can provide rigidity and stability to strap assembly 12 and to strap system 10. In some embodiments, handle base 16 can be comprised of one or more of cardboard, metal, wood, rigid plastic and other like material as well known to those skilled in the art. In some embodiments, when one vertical strap 20 is used, it will need to be placed near the center of gravity of box 1 so that it is balanced when lifted by strap assembly 12. In other embodiments, when two vertical straps 20 are used, the two straps 20 can be placed on the outer ends of strap assembly 12, respectively, near strap connectors 24 that can allow for more stability and security when attached to box 1.

In the illustrated embodiment, handle 14 and vertical straps 20 can be fastened to handle base 16 with fasteners 18. While the illustrated embodiment shows fasteners 18 to be threaded nut and bolt fasteners, those skilled in the art would understand that fasteners 18 can comprise one or more of threaded fasteners, rivets, grommets, threaded stitching, adhesives and any other fastening means as well known to those skilled in the art. In some embodiments, handle 14 can be comprised of one or more of fabric, nylon or polyester webbing, leather, rubber, metal or non-metal reinforcement strands and the like as well known to those skilled in the art. In some embodiments, handle 14 can be operatively coupled to strap attachment members 17 with rings or buckles 15. In some embodiments, each of vertical straps 20 can further comprise strap connector 22 to permit easy wrapping of perimeter straps 20 around box 1 in a vertical direction, and then to fasten the ends of vertical straps 20 together with strap connector 22. In some embodiments, straps 20 can be comprised of one or more of fabric, nylon or polyester webbing, leather, rubber, metal or non-metal reinforcement strands and the like as well known to those skilled in the art.

In some embodiments, strap connector can comprise of a quick release connector, also known as side release connectors, buckle connectors, bayonet connectors and cam buckles as well known to those skilled in the art. Such connectors can comprise means for quick coupling and uncoupling of the connector ends in addition to including means for tightening the slack of the perimeter strap by pulling the loose end of the strap taut after the connectors ends have been joined together.

Figure 4:
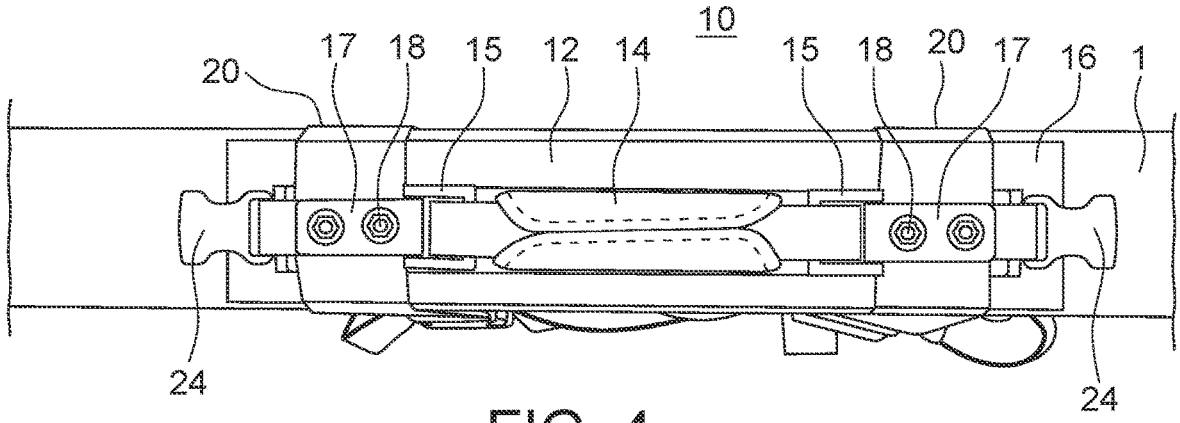
FIG. 4 is a top plan view depicting the cargo carrying strap system of FIG. 1.
Figure 5:
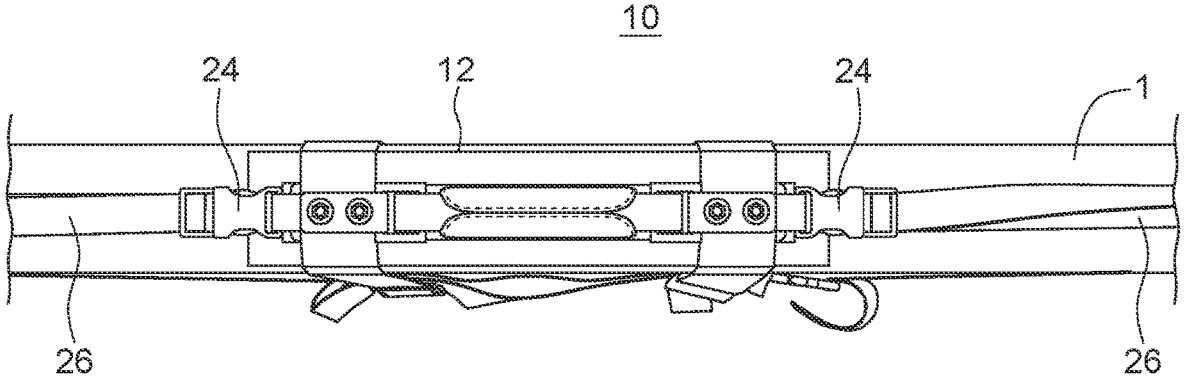
FIG. 5 is a top plan view depicting a second embodiment of a cargo carrying strap system attached to a box.
Figure 6:
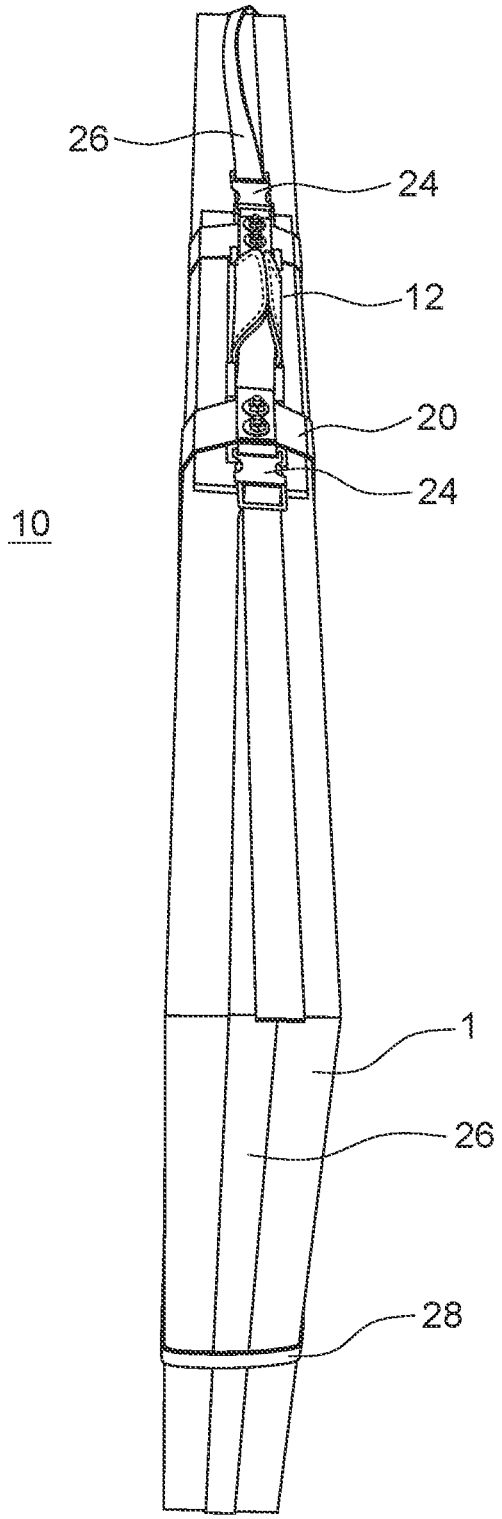
FIG. 6 is an end perspective view depicting the cargo carrying strap system of FIG. 5.
Figure 7:
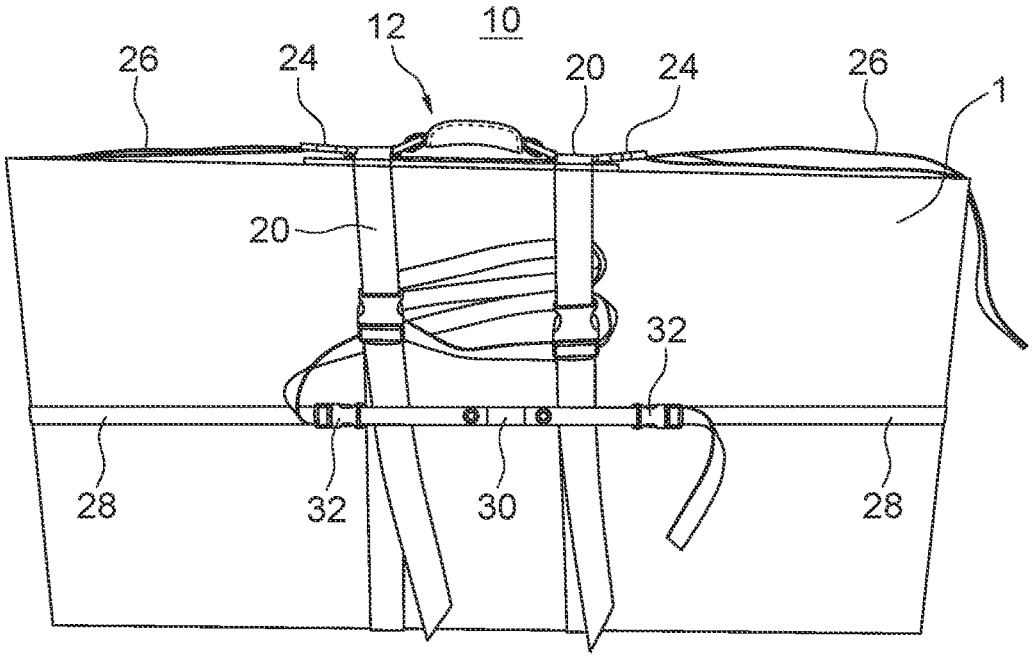
FIG. 7 is a front side elevation view depicting the cargo carrying strap system of FIG. 5.
Figure 8:
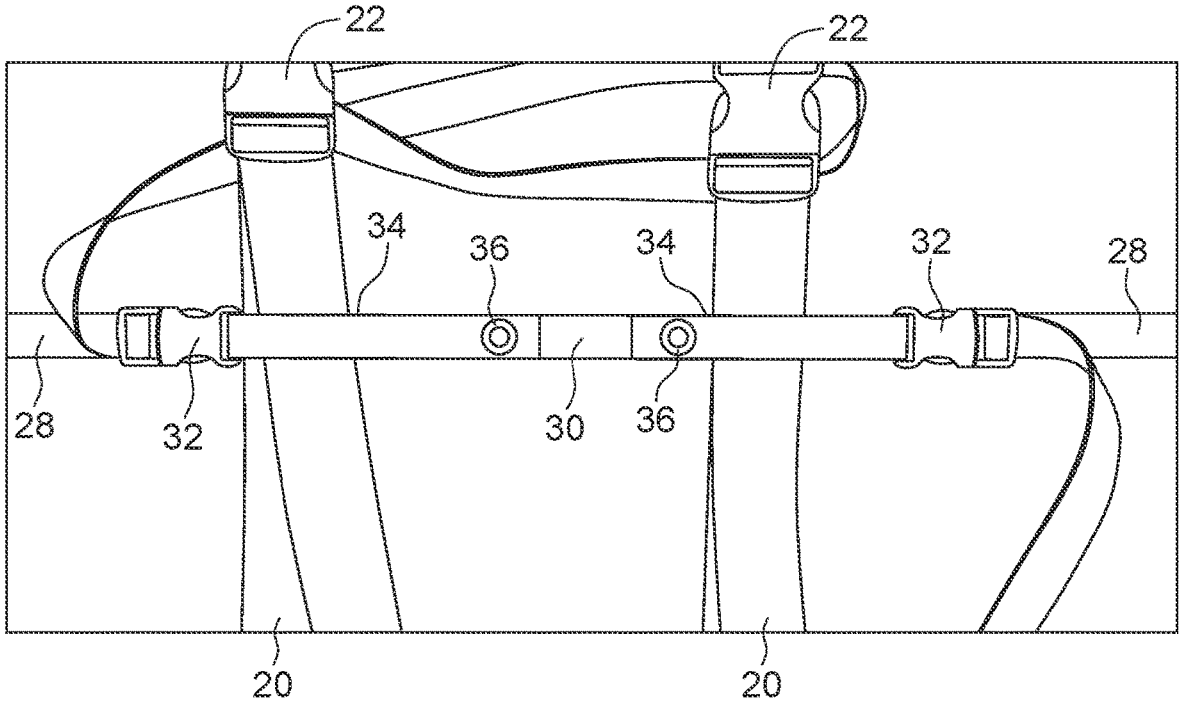
FIG. 8 is a side elevation view depicting a connector strap of the cargo carrying strap system of FIG. 5.
Figure 9:
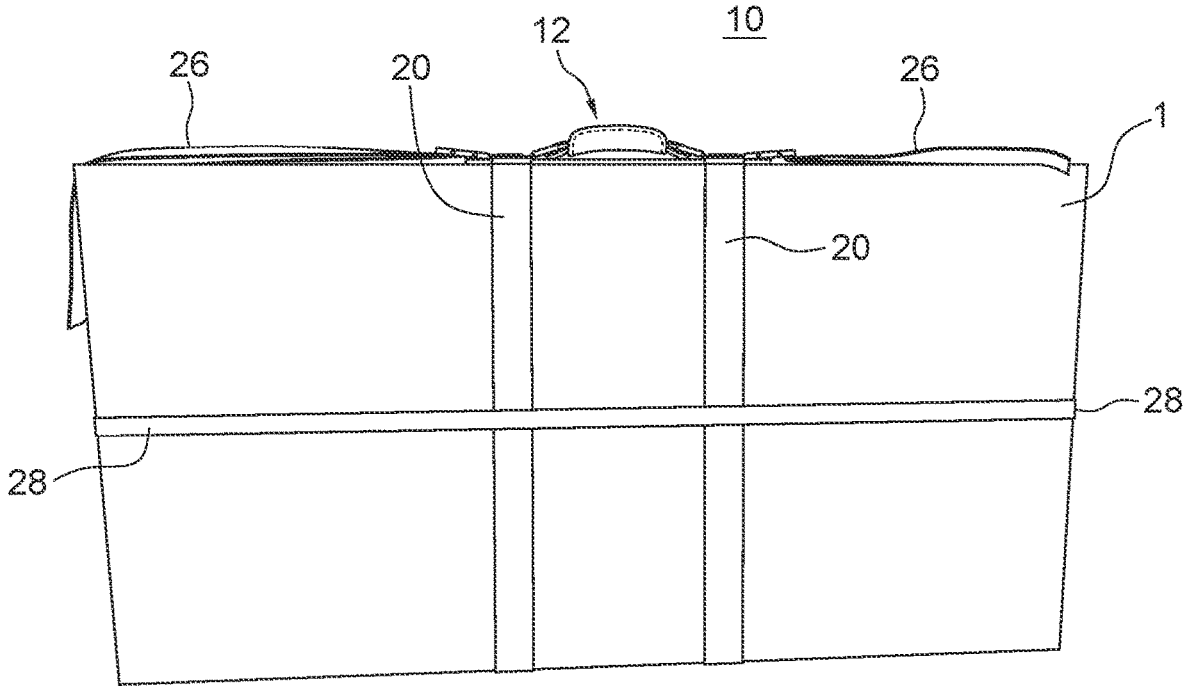
FIG. 9 is a rear side elevation view depicting the cargo carrying strap system of FIG. 5.

Referring to FIGS. 4 to 9, a second embodiment of cargo carrying strap system 10 is shown. As shown in FIG. 4, strap assembly 12 can further comprise of additional strap connectors 24 disposed on opposing ends thereof. Referring to FIG. 5, box perimeter strap 26 can be disposed around an edge perimeter of box 1 as shown wherein perimeter strap 26 can couple to strap assembly 12 via strap connectors 24. Referring to FIGS. 6 to 9, in some embodiments, cargo carrying strap system 10 can further comprise of horizontal strap 28 disposed around a horizontal perimeter of box 1, as shown in these figures. In some embodiments, either or both of straps 26 and 28 can be comprised of one or more of fabric, nylon or polyester webbing, leather, rubber, metal or non-metal reinforcement strands and the like as well known to those skilled in the art.

In some embodiments, strap system 10 can further comprise of connector strap 30, which can comprise of a single strap comprised of one or more of fabric, nylon or polyester webbing, leather, rubber, metal or non-metal reinforcement strands and the like as well known to those skilled in the art, with each end of connector strap 30 wrapped around one of straps 20 to form loops 34, with the strap ends then secured to connector strap 30 with fasteners 36, which can comprise one or more of threaded fasteners, rivets, grommets, threaded stitching, adhesives and the like. Connector strap 30 can further comprise strap connectors 32 disposed on opposing ends thereof to provide means for attaching horizontal strap 28 to. In some embodiments, connector strap 30 can move freely on straps 20 as straps 20 can be inserted through loops 34 before being connected together with strap connectors 22. Thus, in some embodiments, connector strap 30 and horizontal strap 28 can be implemented on strap system 10 for additional strength and security in enclosing box 1 therewith.

In some embodiments, strap system 10 can use vertical straps 20, perimeter strap 26 and horizontal strap 28 to encase box 1 on each of its orthogonal axes to provide secure attachment of strap system 10 thereto. By attaching strap system 10 to box 1 in this manner, box 1 can then easily be lifted and carried by grasping handle 14. After moving box 1, strap system 10 can then be removed from box 1 by releasing all of the strap connectors.

Although a few embodiments have been shown and described, it will be appreciated by those skilled in the art that various changes and modifications can be made to these embodiments without changing or departing from their scope, intent or functionality. The terms and expressions used in the preceding specification have been used herein as terms of description and not of limitation, and there is no intention in the use of such terms and expressions of excluding equivalents of the features shown and described or portions thereof, it being recognized that the invention is defined and limited only by the claims that follow.

We claim:

1. A strap system for lifting and carrying cargo, the system comprising:

a) a strap assembly for placement on top of the cargo, the strap assembly further comprising a handle operatively coupled to a planar handle base configured for providing rigidity and stability to the strap assembly;

b) at least one vertical strap operatively attached to the strap assembly between the handle and the planar handle base with at least one fastener extending through the handle, the at least one vertical strap, and then the planar handle base, the at least one vertical strap configured for wrapping around a vertical perimeter of the cargo;

c) a connector strap disposed on the at least one vertical strap, the connector strap further comprising second releasable strap connectors; and d) a horizontal strap for releasably attaching to the second releasable strap connectors of the connector strap, wherein the combination of the horizontal strap releasably attached to the connector strap is configured for wrapping around a horizontal perimeter of the cargo.

2. The strap system as set forth in claim 1, wherein the at least one vertical strap further comprises a first releasable strap connector.

3. The strap system as set forth in claim 1, wherein the planar handle base is rectangular.

4. The strap system as set forth in claim 1, wherein the at least one fastener comprises one or more of threaded fasteners, rivets, grommets, threaded stitching, and adhesive.

5. The strap system as set forth in claim 1, further comprising an edge perimeter strap configured for wrapping around an edge perimeter of the cargo, the edge perimeter strap configured for releasably attaching to the strap assembly.

6. The strap system as set forth in claim 5, further comprising third releasable strap connectors disposed on opposing ends of the strap assembly configured for releasably attaching to the edge perimeter strap.

7. The strap system as set forth in claim 1, wherein the horizontal strap is orthogonal to the at least one vertical strap.

8. The strap system as set forth in claim 5, wherein the edge perimeter strap is orthogonal to the at least one vertical strap.

9. The strap system as set forth in claim 5, wherein the edge perimeter strap is orthogonal to the horizontal strap.

10. The strap system as set forth in claim 5, wherein the edge perimeter strap is orthogonal to both the at least one vertical strap and the horizontal strap.

11. The strap system as set forth in claim 1, wherein the connector strap is configured to move freely on the at least one vertical strap.

12. A method for lifting and carrying cargo, comprising:

a) placing a strap system onto the cargo, the strap system comprising:

i) a strap assembly for placement on top of the cargo, the strap assembly further comprising a handle operatively coupled to a planar handle base configured for providing rigidity and stability to the strap assembly, ii) at least one vertical strap operatively attached to the strap assembly between the handle and the planar handle base with at least one fastener extending through the handle, the at least one vertical strap, and then the planar handle base, the at least one vertical strap configured for wrapping around a vertical perimeter of the cargo, iii) a connector strap disposed on the at least one vertical strap, the connector strap further comprising second releasable strap connectors, and iv) a horizontal strap for releasably attaching to the second releasable strap connectors of the connector strap, wherein the combination of the horizontal strap releasably attached to the connector strap is configured for wrapping around a horizontal perimeter of the cargo;

b) fastening the strap system to the cargo; and c) carrying out a step of one or both of lifting and carrying the cargo.

13. The method as set forth in claim 12, wherein the at least one vertical strap further comprises a first releasable strap connector.

14. The method as set forth in claim 12, wherein the at least one fastener comprises one or more of threaded fasteners, rivets, grommets, threaded stitching, and adhesive.

15. The method as set forth in claim 12, wherein the horizontal strap is orthogonal to the at least one vertical strap.

16. The method as set forth in claim 12, wherein the strap system further comprises an edge perimeter strap configured for wrapping around an edge perimeter of the cargo, the edge perimeter strap configured for releasably attaching to the strap assembly.

17. The method as set forth in claim 16, wherein the strap system further comprises third releasable strap connectors disposed on opposing ends of the strap assembly configured for releasably attaching to the edge perimeter strap.

18. The method as set forth in claim 16, wherein the edge perimeter strap is orthogonal to the at least one vertical strap.

19. The method as set forth in claim 16, wherein the edge perimeter strap is orthogonal to the horizontal strap.

20. The method as set forth in claim 12, wherein the connector strap is configured to move freely on the at least one vertical strap.

* * * * *